United States Patent [19]

Spain

[11] 4,221,089

[45] Sep. 9, 1980

[54] FAIL-SAFE STOP ARRANGEMENT FOR CRANE BOOM EXTENSION CABLE

[75] Inventor: Stanley R. Spain, Waynesboro, Pa.

[73] Assignee: Walter Kidde & Company, Inc., Clifton, N.J.

[21] Appl. No.: 11,761

[22] Filed: Feb. 12, 1979

[51] Int. Cl.[2] ..... E04H 12/34

[52] U.S. Cl. ..... 212/267; 52/118; 52/121

[58] Field of Search ..... 52/117, 118, 121; 212/55

[56] References Cited

U.S. PATENT DOCUMENTS

| | | | |
|---|---|---|---|
| 2,896,750 | 7/1959 | Eitel | 52/118 X |
| 3,396,601 | 8/1968 | Wright | 52/121 X |
| 3,411,747 | 11/1968 | Lister, Jr. et al. | 52/121 X |
| 3,693,755 | 9/1972 | Terayama | 212/55 UX |
| 3,817,007 | 6/1974 | Hall | 52/121 X |
| 3,845,596 | 11/1974 | Veenstra | 52/121 X |
| 4,133,411 | 1/1979 | Curb | 52/118 X |
| 4,156,331 | 5/1979 | Lester et al. | 52/118 X |

*Primary Examiner*—Price C. Faw, Jr.
*Assistant Examiner*—Carl D. Friedman
*Attorney, Agent, or Firm*—Brady, O'Boyle & Gates

[57] ABSTRACT

A pair of safety stop blocks are welded to opposite sides of the fly section of a construction crane boom. The stop blocks have slide passages to receive the branches of a boom extension or load cable which is looped around an arcuate saddle near the base of the fly section. A pair of stop buttons are swaged to the extension cable branches between the saddle and the two stop blocks and are normally spaced somewhat from the stop blocks to allow the cable to seek an equal loading position around the saddle. The stop blocks carry cable retainer elements near the tops of the slide passages to prevent the escape of the cable therefrom. Should the extension cable fail in any region thereof under load, at least one swaged stop button will be engaged by a stop block of the boom fly section to positively arrest its retractive movement before any damage can occur.

9 Claims, 8 Drawing Figures

FIG. 1
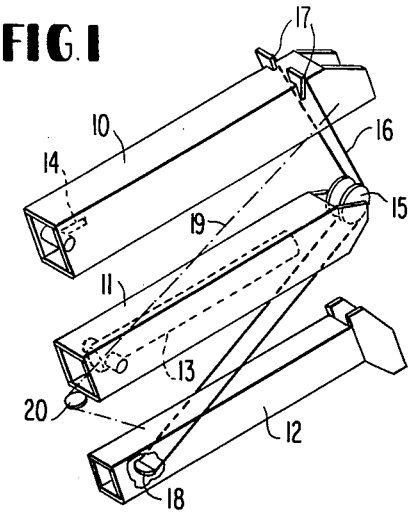
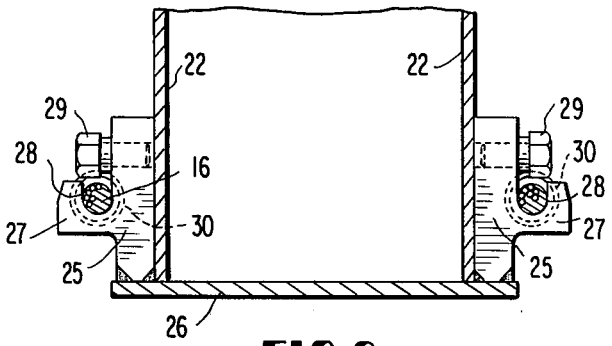
FIG. 8
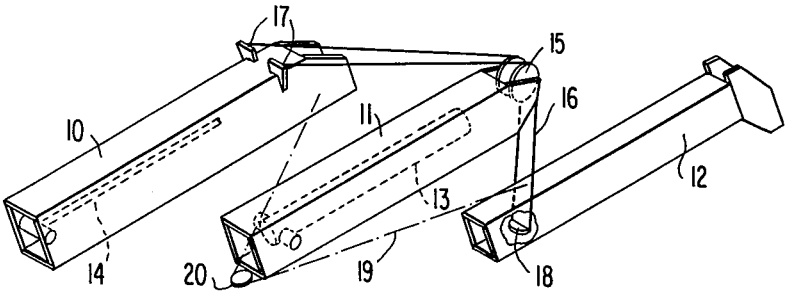
FIG. 2
FIG. 3
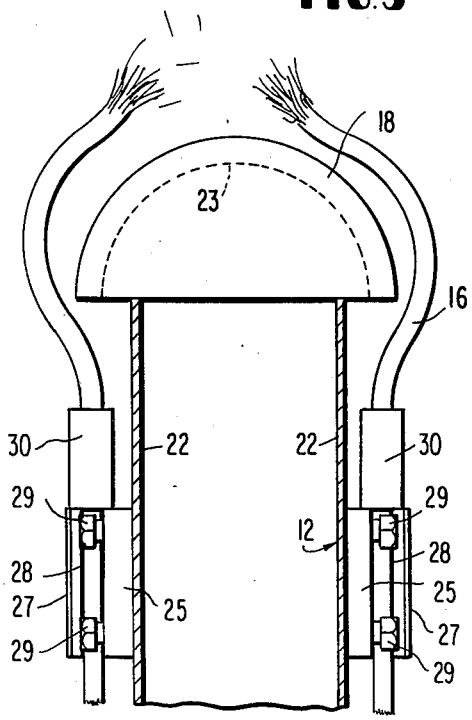
FIG. 4
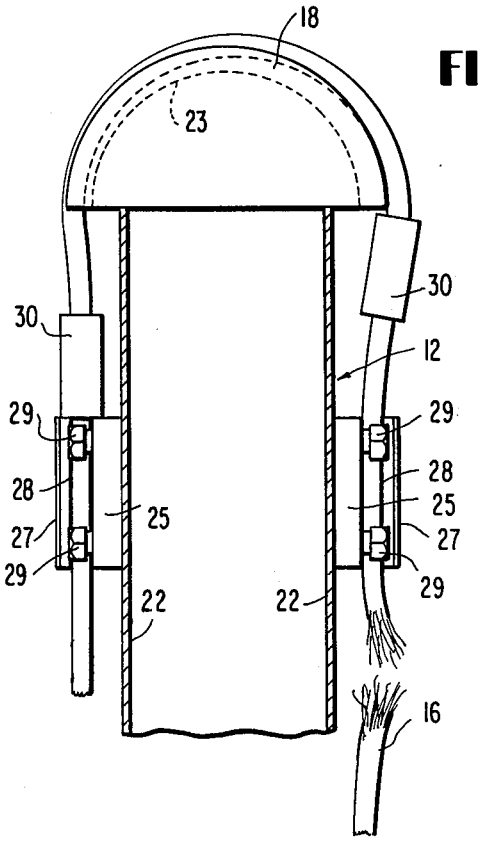

FAIL-SAFE STOP ARRANGEMENT FOR CRANE BOOM EXTENSION CABLE

BACKGROUND OF THE INVENTION

Modern-day construction cranes, such as telescoping boom cranes, like all heavy equipment, are designed with safety in mind, and great care is exercised to provide all necessary safety devices including signal devices to alert the crane operator to an approaching or existing safety hazard during the operation of the crane. Despite strenuous efforts to provide the best safety features on cranes and other construction machinery, there are always some accidents and after the occurence of such accidents efforts are renewed to prevent the accident from recurring.

The present invention relates to a safety device or arrangement for cranes which is intended to deal with one particular potential hazard which could result in a serious accident even though the likelihood of such an accident is remote. In telescoping boom cranes of a certain type, the boom fly section is extended from the next interior section by an extension cable reeved over pulley means on the next interior boom section and positively anchored to a further interior boom section, such as the boom base section. This fly section extension cable actually bears the load which is being carried by the boom and should the extension cable part or fail at any point the fly section would retract with the load out of control, possibly resulting in a very serious accident.

This invention seeks to provide an extremely simple fail-safe arrangement in the form of a safety stop device having components on the extension cable and on the boom fly section which come into positive contact substantially instantly in the event of failure of the extension cable to prevent the retraction of the loaded fly section without control. The arrangement is compact, extremely strong and adds very little to the cost of the equipment while greatly enhancing its safety, and does not interfere with normal operations of the boom or require any significant modification of the conventional construction of the boom.

Various detailed features of the invention will be apparent during the course of the following description.

SUMMARY OF THE INVENTION

Near its base, the fly section of a telescoping crane boom has fixed to its opposite sides a pair of rigid stop blocks which have top opening slide passages for the branches of a fly section extension cable which passes around a curved saddle near the base of the fly section. Retainer elements, such as screws, mounted on the sides of the stop blocks immediately above the cable slide passages prevent the cable branches from escaping the passages but do not impede freedom of adjustment of the cable relative to the saddle. A pair of safety stop buttons or elements are securely swaged to the extension cable branches between the two safety stop blocks and the saddle. If the extension cable should part anywhere in the region between the swaged buttons, both stop blocks will engage the two buttons to instantly arrest retractive movement of the boom fly section and thus prevent an accident. If either cable branch fails or parts forwardly of the stop blocks, the opposite side stop block will engage the adjacent swaged button and similarly prevent an accident due to retractive movement of the boom fly section out of control.

BRIEF DESCRIPTION OF THE DRAWINGS

FIG. 1 is a schematic exploded perspective view of a three section crane boom having an extension cable for the boom fly section and a separate retraction cable, the boom being shown in retracted state.

FIG. 2 is a similar perspective view showing the same boom extended.

FIG. 3 is a fragmentary plan view, partly in section, showing the base portion of the boom fly section and the safety stop arrangement according to the invention in the active state, as where the extension cable has parted where it passes around the curved saddle.

FIG. 4 is a view similar to FIG. 3 showing the action of the safety stop arrangement where one branch of the extension cable has parted ahead of one stop block.

FIG. 8 is a similar section taken on line 8—8 of FIG. 5.

DETAILED DESCRIPTION

Figure 5:
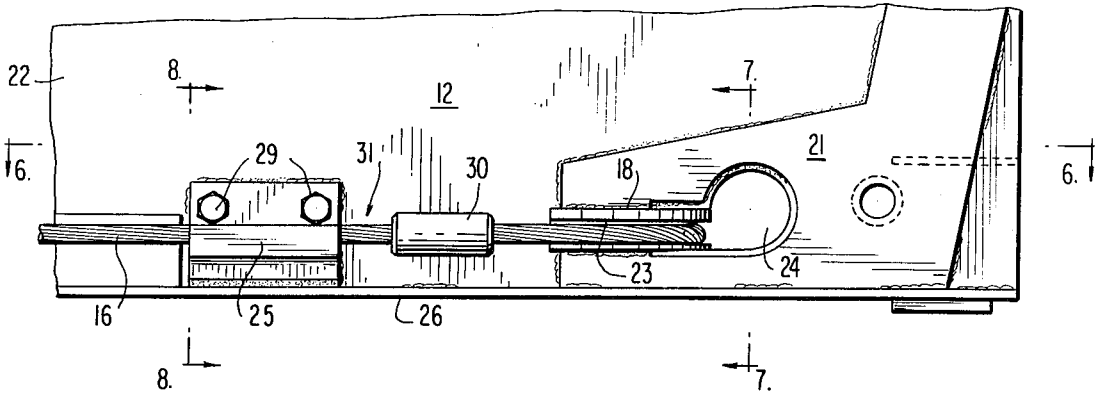
FIG. 5 is a fragmentary side elevational view of the invention.

Referring to the drawings in detail wherein like numerals designate like parts, the numeral 10 designates a crane boom base section which may telescopically receive therein a boom mid-section 11, which in turn may telescopically receive a fly section 12. While a three section telescopic crane boom is shown in the drawings, it should be recognized that the invention is applicable to other telescopic booms, such as those having four or more sections.

Figure 6:
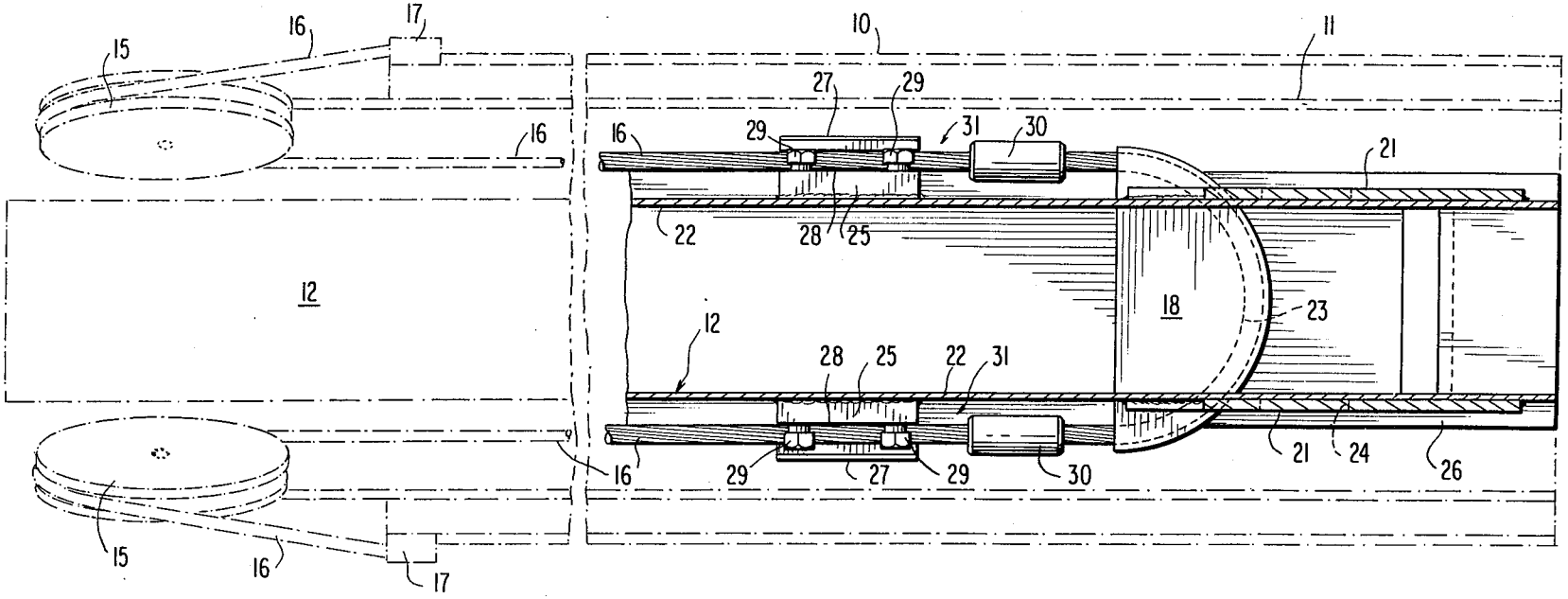
FIG. 6 is a horizontal section taken on line 6—6 of FIG. 5.
Figure 7:
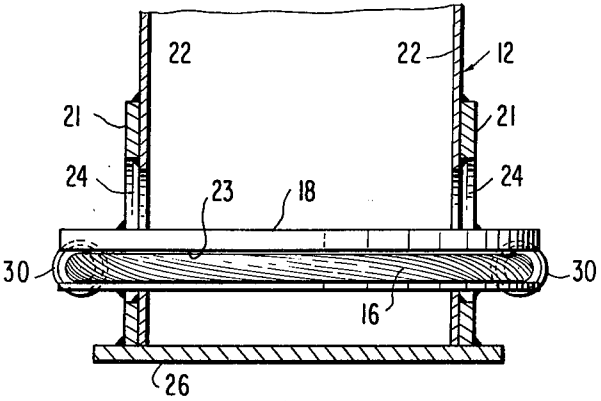
FIG. 7 is a transverse vertical section taken on line 7—7 of FIG. 5.

The construction of the three section boom in general is conventional. The boom mid-section 11 is extended and retracted relative to the base section 10 by the operation of a cylinder 13 in the mid-section 11 whose rod 14 is connected to the base section 10. When this cylinder 13 is extended, as depicted in FIG. 2, a guide pulley 15 for the extension cable 16 of the fly section 12 is also extended. The cable 16 has its two ends fixed at 17 to the base section 10 and the extension cable 16 is looped around a grooved arcuate saddle 18 on the boom fly section 12 near its interior end. Therefore, when the mid-section 11 and pulley 15 travel outwardly from the base section 10 under influence of cylinder 13, the fly section 12 will also be extended. This construction and operation, as thus far described, is conventional and is set forth to establish the environment for the invention as detailed in FIGS. 3–8. The extension cable 16 is a load bearing cable which resists retractive movement of the fly section 12 whether loaded or unloaded. In the arrangement shown, the fly section 12 is not connected directly to any cylinder. The conventional boom in FIGS. 1 and 2 also comprises a retraction cable 19 for the fly section 12 shown schematically. This retraction cable has one end attached to the base section 10 and is reeved about a guide pulley 20 on the mid-section 11 and is connected to the fly section 12. Thus, when the mid-section 11 of the boom is retracted by the cylinder 13 in a controlled manner, the retraction cable 19 will similarly cause retraction of the fly section 12 in a controlled manner.

The sole purpose of the invention now to be described in detail is to deal with the hazard which can arise when the extension cable 16 fails or parts in either of the two situations shown in FIGS. 3 and 4. Referring to these figures along with FIGS. 5 through 8, the aforementioned arcuate saddle 18 is in the form of a sturdy semi-circular plate positioned in a slot formed laterally through the fly section 12 from side-to-side thereof. The saddle 18 is welded within this lateral slot, FIG. 7, and further welded to side plate reinforcements 21 which in turn are welded to the opposite side plates 22 of the fly section. The saddle 18 projects beyond the opposite side walls of the fly section equidistantly and has a seating groove 23 for the extension cable 16 formed in its arcuate edge. The slot in the boom fly section 12 within which the saddle 18 is welded preferably has an enlarged clearance opening 24 formed through each side wall of the fly section and through the reinforcement plates 21.

Somewhat forwardly of the fixed saddle 18, a pair of rigid stop blocks 25 are welded to the opposite side walls 22 of the fly section and are further welded to the bottom wall 26 of the fly section. The two stop blocks 25 are in lateral alignment on the boom fly section, FIGS. 4 and 6. Each stop block carries a side extension 27 having a top opening longitudinal U-cross section slide passage 28 for one branch of the extension cable 16 which includes two parallel branches extending in parallel relation along and somewhat outwardly of the fly section side plates 22. These two cable branches are received slidably in the passages 28 and are retained therein against upward displacement and separation from the passages by pairs of retainer screws 29 or the like anchored in threaded openings of the two blocks 25 above the passages 28. The looped portion of the extension cable 16 seated in the arcuate saddle groove 23 can also slide relative to the saddle so that the cable can automatically seek a position of equal loading on both of its sides or branches.

A pair of safety stop buttons 30 of cylindrical formation are securely swaged onto the two cable branches in normal equidistantly spaced or symmetrical relationship to the saddle 18. The stop buttons 30 are also spaced slightly at 31 from the opposing stop blocks 25 in order to allow the necessary sliding and self-adjusting of the extension cable on the saddle 18 for equal loading, as described.

Referring to FIGS. 3 and 4, with the fly section 12 extended and carrying a load, there is a remote chance that the cable 16 could fail or part where it passes around the saddle 18 as depicted in FIG. 3. Should this occur, the loaded fly section 12 under gravity will begin retractive movement, out of control, and substantially instantly its two stop blocks 25 will engage the swaged stop buttons 30, as shown in FIG. 3, to positively stop the collapsing of the fly section, thus avoiding an accident. Even if the cable 16 parts on one side of the fly section 12, FIG. 4, outwardly of the stop blocks 25, the opposite side stop block will instantly engage the adjacent stop button 30 which will arrest the retractive movement of the fly section 12 and prevent the accident.

It should now be clear that a fail-safe capability has been imparted to the fly section extension cable 16 by the simple and economical provision of the two stop blocks 25 on opposite sides of the fly section, in cooperative relationship with the two swaged stop buttons 30 on the cable. The arrangement is compact, very reliable and quite economical.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a multi-section telescoping crane boom having a fly section and a load bearing extension cable for said fly section, a fixed saddle on said fly section near the interior end thereof and having an arcuate seat, and said extension cable being slidably engaged in said seat and extending in two branches from the seat along opposite sides of the fly section exteriorly thereof, the improvement comprising a pair of safety stop blocks fixed to the opposite sides of said fly section in spaced relationship to said saddle and having guide passages for the two branches of said cable and slidably receiving said branches, and a pair of safety stop elements fixed securely on said cable in the region between said saddle and stop blocks and being normally in equidistantly spaced relationship to the opposing end faces of the stop blocks to allow said cable to seek a position of equal loading on each of its branches by sliding relative to the saddle and stop blocks.

2. In a multi-section telescoping crain boom as defined in claim 1, and said guide passages for the two branches of said cable being in the form of top opening channels, and cable retainer elements secured to said stop blocks above and overlying said channels and blocking upward displacement of said cable branches.

3. In a multi-section telescoping crane boom as defined in claim 1, and said pair of safety stop elements comprising buttons swaged on the branches of said extension cable.

4. In a multi-section telescoping crane boom as defined in claim 1, and said stop blocks being welded to the opposite sides of said fly section.

5. In a multi-section telescoping crane boom as defined in claim 2, and said retainer elements comprising at least one screw on each stop block extending across the axis of the adjacent top opening channel.

6. In a multi-section telescoping crane boom as defined in claim 2, and said stop blocks including outwardly projecting side extensions, and said channels being formed in the top faces of the side extensions adjacent to outer faces of the body portions of said stop blocks, said cable retainer elements being anchored to said body portions closely above said side extensions and across the axes of said channels.

7. In a multi-section telescoping crane boom as defined in claim 3, and said swaged buttons being elongated on the axes of said cable branches to promote maximum gripping of the buttons on the cable branches.

8. In a multi-section telescoping crane boom having a load bearing boom extension cable and a boom section extendable by the cable, arcuate seat means on said boom section near the interior end thereof, and said extension cable moveably engaging said seat means and extending in two branches from the seat means along opposite exterior sides of said boom section, the improvement comprising a pair of safety stop blocks fixed to the opposite sides of said boom section in spaced relation to said arcuate seat means and having guide passages for the two branches of said extension cable and slidably receiving said branches, and a pair of safety stop elements fixed securely on said extension cable in the region between said arcuate seat means and said stop blocks and having diameters greater than the width of said guide passages.

9. In a multi-section telescoping crane boom, as set forth in claim 8, in which said stop blocks include end stop faces adapted to engage at least one of said stop elements upon the parting of said extension cable.

* * * * *